US007104639B2

(12) United States Patent
Hermes et al.

(10) Patent No.: US 7,104,639 B2
(45) Date of Patent: Sep. 12, 2006

(54) APPARATUS FOR REFILLING INK CARTRIDGES

(76) Inventors: Edgard J. Hermes, 59 Woodlawn Ave., Broomall, PA (US) 19008; Patrick E. Hermes, 59 Woodlawn Ave., Broomall, PA (US) 19008; Joseph E. Hermes, 59 Woodlawn Ave., Broomall, PA (US) 19008

( * ) Notice: Subject to any disclaimer, the term of this patent is extended or adjusted under 35 U.S.C. 154(b) by 276 days.

(21) Appl. No.: 10/914,577

(22) Filed: Aug. 9, 2004

(65) Prior Publication Data

US 2006/0028515 A1 Feb. 9, 2006

(51) Int. Cl.
*B41J 2/175* (2006.01)

(52) U.S. Cl. ..... 347/85

(58) Field of Classification Search ..... 347/7, 347/85; 141/2, 18; 238/305, 308
See application file for complete search history.

(56) References Cited

U.S. PATENT DOCUMENTS 4,617,692 A * 10/1986 Bond et al. ..... 7/158
4,831,389 A 5/1989 Chan ..... 346/140
4,999,652 A 3/1991 Chan ..... 346/140
5,531,055 A * 7/1996 Sell et al. ..... 53/86
5,631,681 A * 5/1997 Klaus et al. ..... 347/85
5,721,576 A * 2/1998 Barinaga ..... 347/85
5,745,137 A 4/1998 Scheffelin et al. ..... 347/85
5,880,748 A 3/1999 Childers et al. ..... 347/6
5,880,764 A 3/1999 Barinaga ..... 347/86
5,975,677 A 11/1999 Marler et al. ..... 347/40
6,030,073 A 2/2000 Coiner et al. ..... 347/84
6,065,828 A 5/2000 Lo et al. ..... 347/85
6,065,829 A 5/2000 Ruiz et al. ..... 347/85
6,076,920 A 6/2000 Zapata et al. ..... 347/85
6,799,610 B1 * 10/2004 Yuen ..... 141/2
7,063,269 B1 * 6/2006 Molyneux ..... 238/287

FOREIGN PATENT DOCUMENTS

JP 09094799 * 8/1997
JP 09277550 * 10/1997

* cited by examiner

*Primary Examiner*—Anh T. N. Vo
(74) *Attorney, Agent, or Firm*—Robert S. Lipton, Esq.; Lipton, Weinberger and Husick

(57) ABSTRACT

The Invention is an apparatus for refilling ink cartridges, such as ink cartridges for ink jet printers. The cartridge is attached to a table. The table is rotatable with respect to a base through a series of stations. The stations include guides to locate an aperture in the ink cartridge and to locate a reservoir for filling the ink cartridge. A cartridge sealing assembly seals the aperture, but allows a hollow pin to be inserted for filling the cartridge.

20 Claims, 7 Drawing Sheets

APPARATUS FOR REFILLING INK CARTRIDGES

FIELD OF THE INVENTION

The Invention is an apparatus for refilling cartridges, such as ink cartridges for ink jet printers. The apparatus is adapted to receive the ink cartridge and to hold the cartridge as the cartridge is moved through four stations. The stations are adapted to facilitate the preparation and filling of the ink cartridge.

DESCRIPTION OF THE RELATED ART

The ink jet printer is an inexpensive and popular peripheral for use in personal computer systems. Ink jet printers also are used in many applications where high quality, inexpensive printing is required, such as fax machines, copiers and word processors.

A common type of inkjet technology is "drop on demand." A motor drive moves a print head across a page or other media to be printed in horizontal strips. A cartridge motor drive rolls the paper in vertical steps. Small droplets of ink are projected through between 300 and 600 nozzles onto paper as the nozzles pass over the paper. Printer driver software controls the operation of the nozzles.

Most inkjets use a thermal technology to project the ink onto the paper. Minute heating elements heat the ink to create a bubble. The pressure created by the bubble ejects ink through a nozzle at the time and location dictated by the printing software. Thermal printing inks must be heat resistant to withstand the heat required to project the ink through a nozzle.

Piezo technology is an alternative to thermal technology. In piezo technology, vibration of a piezo crystal in response to an electrical signal provides the motive force to project ink from the nozzles. Piezo technology inks can be fast drying solvent-based inks and are not required to have the same heat resistance as thermal printing inks.

An ink jet printer can consume a significant quantity of ink. While the initial expense of an ink jet printer is low, the maintenance costs can be quite high due to the short life and high cost of ink cartridges.

The issue of the low capacity of ink jet cartridges has been recognized by the industry and several attempts have been made to rectify the problem. U.S. Pat. No. 4,831,389 to Chan issued on May 16, 1989 teaches large ink reservoirs that wick ink to an ink jet print head by capillary action. U.S. Pat. No. 6,065,828 to Lo issued on May 23, 2000, teaches that a large volume of a single colorless ink vehicle can be delivered to a print head where the vehicle is mixed with multiple concentrated pigments to form finished inks of various colors. In U.S. Pat. No. 6,065,829 to Ruiz issued May 23, 2000, an ink jet print cartridge is connected automatically to an ink supply periodically and ink drawn by vacuum to replenish the print cartridge.

In recent years, the options available to owners of ink jet printers have expanded due to the entry of aftermarket suppliers of ink jet cartridges and due to the availability of commercial recycling and refill services. Kits also are available to allow a consumer to refill certain ink jet cartridges. Whenever a consumer handles ink in bulk, the risk of a spill is present. An ink spill is likely to result in staining and damage.

The prior art patents and kits do not teach the elements of the present invention.

BRIEF DESCRIPTION OF THE INVENTION

The Invention is an apparatus for refilling ink cartridges, such as ink cartridges used in ink jet printers. The apparatus includes a table that may receive and hold an empty ink cartridge. The table is rotatable with respect to a base and may be moved to any one of four positions with respect to a base, the four positions corresponding to four stations for four operations. An attachment/removal station is adapted to receive and securely retain a holder to which the empty ink cartridge is attached and to allow removal of the filled ink cartridge from the table. A drilling station includes a drilling guide to locate a drill used to drill an aperture in the ink cartridge to receive a cartridge sealing assembly. A cartridge sealing assembly insertion station is adapted to allow the cartridge sealing assembly to be attached to the ink cartridge. The fluid addition station is adapted to hold a reservoir in position to allow ink to flow into the cartridge through the cartridge sealing assembly.

The cartridge sealing assembly acts to sealably receive ink from the reservoir without leakage and to prevent leakage after the cartridge is filled.

DESCRIPTION OF AN EMBODIMENT

Figure 1:
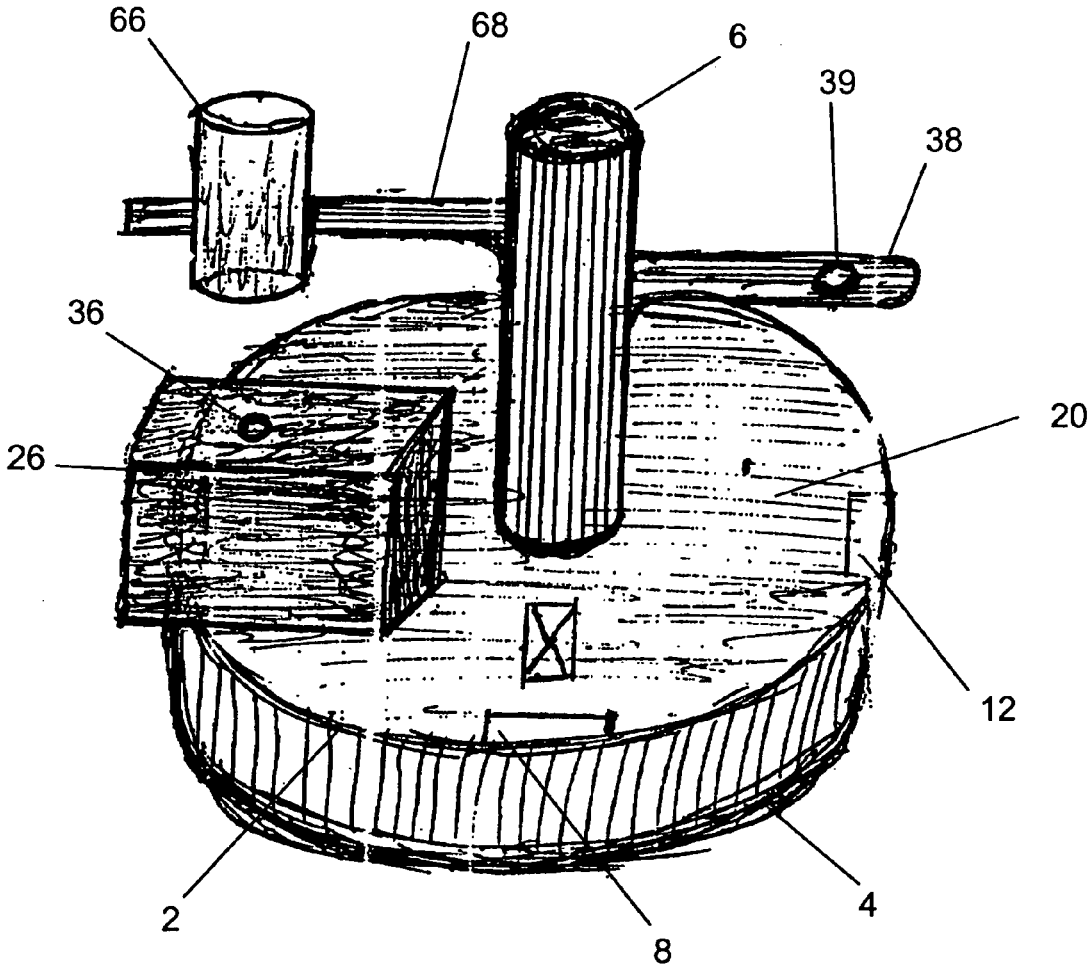
FIG. 1 is a perspective view of the apparatus of the Invention.

FIG. 1 is a perspective view of the apparatus of the Invention. Table 2 is rotatably mounted on a base 4. Member 6 is rigidly attached to base 4. Table 2 may rotate about the member 6. A user may manually depress catch 8 and manually rotating table 2 with respect to base 4.

Figure 2:
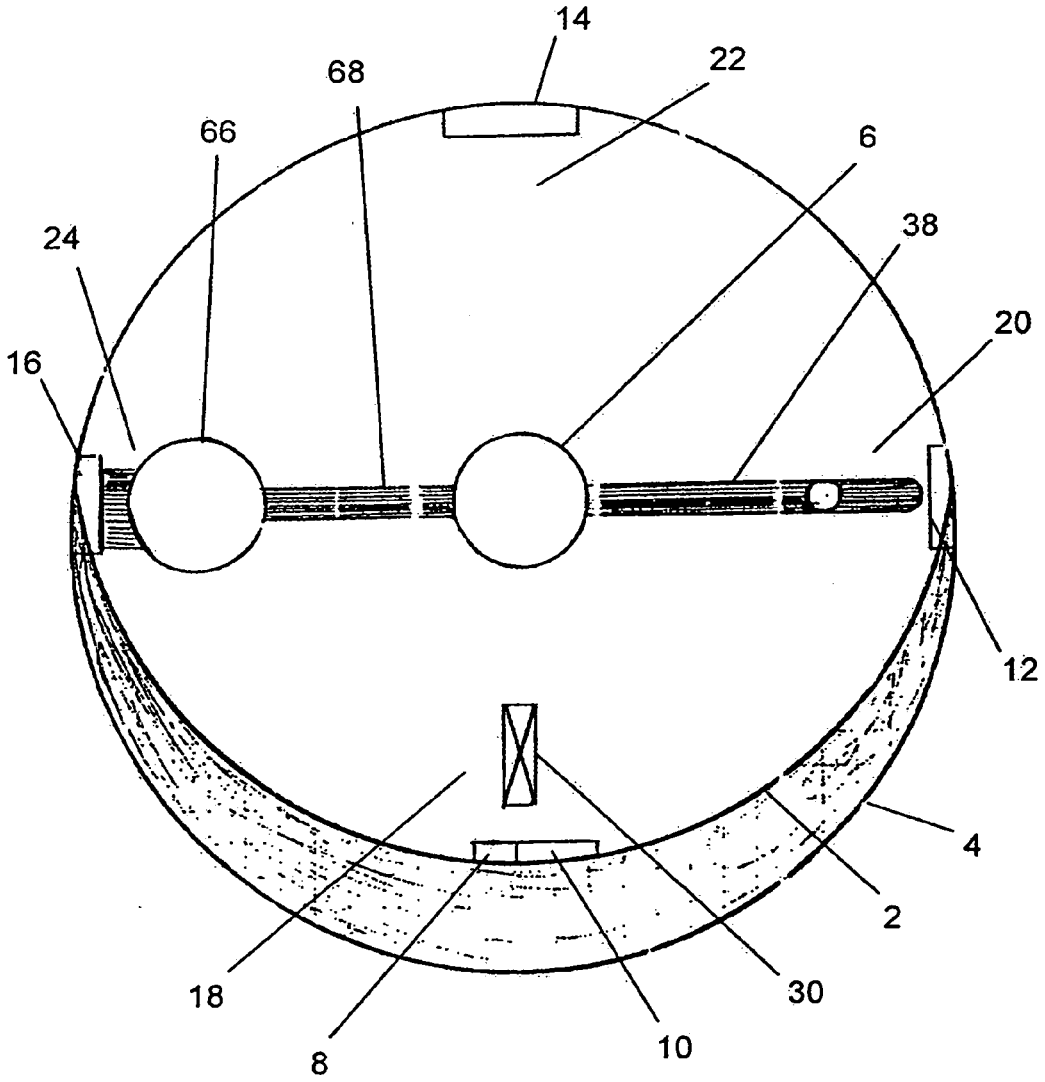
FIG. 2 is a perspective view of the table.

As shown by FIG. 2, the table has four stops 10, 12, 14, 16 allowing catch 8 selectably to secure table 2 in any of four stations 18, 20, 22, 24 with respect to base 4. The various operations required to fill an ink cartridge 26 are performed at each of the four stations 18, 20, 22, 24. Stop 10 corresponds to attachment/removal station 18. Stop 12 corresponds to drilling station 20. Stop 14 corresponds to cartridge sealing assembly insertion station 22. Stop 16 corresponds to fluid addition station 24.

Figure 3:
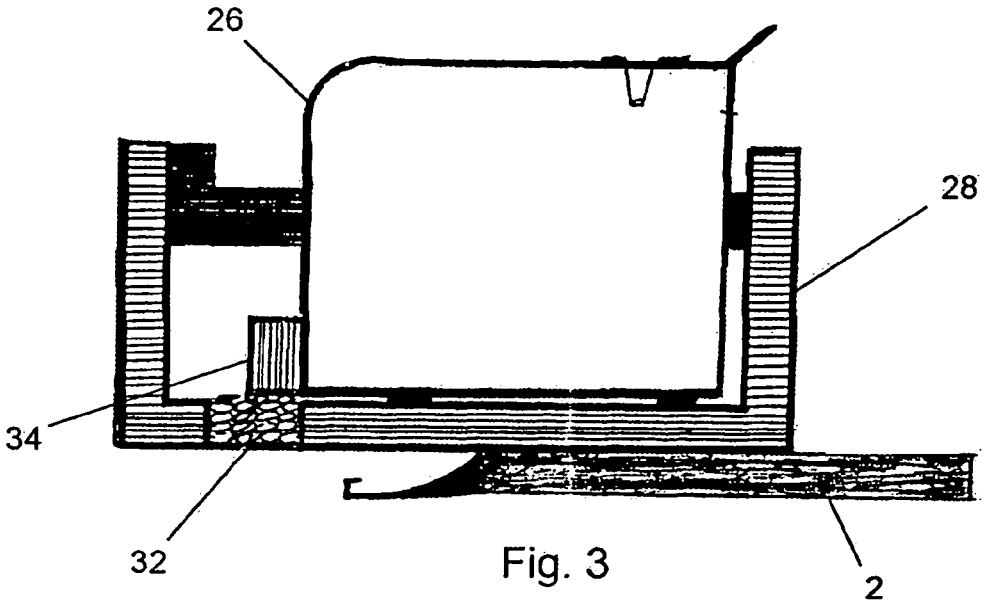
FIG. 3 is a side view of a holder for a large ink cartridge.
Figure 4:
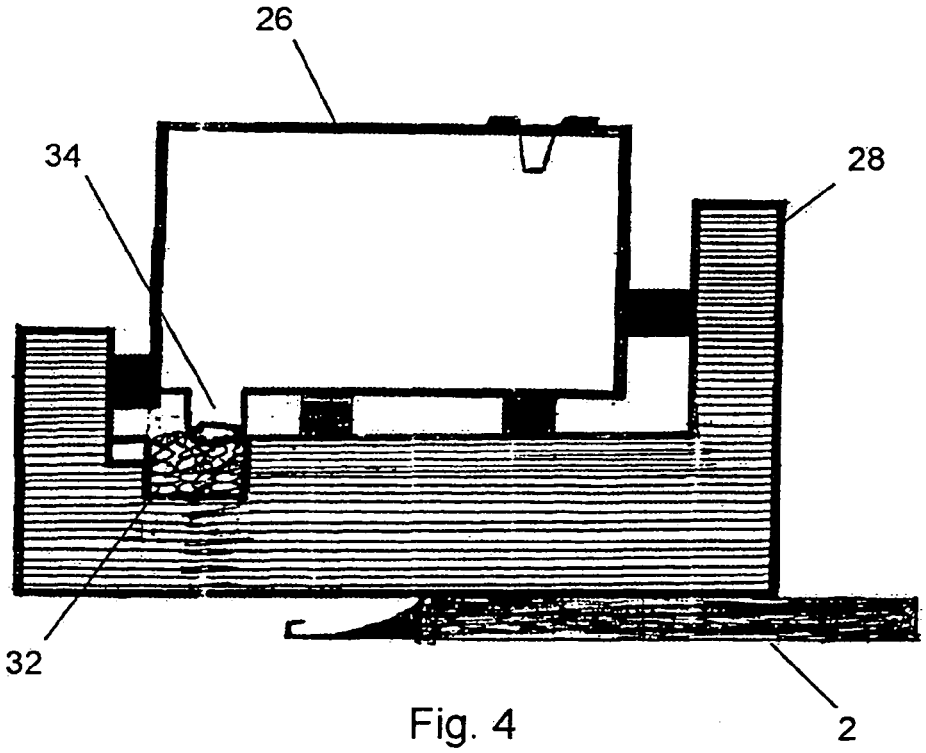
FIG. 4 is a side view of a holder for a small ink cartridge.

From FIGS. 3 and 4, ink cartridge 26 is held on table 2 by holder 28. Holder 28 is tailored to the ink cartridge 26 to be filled and is designed to hold cartridge 26 in the proper position and orientation and at the proper height for the operations of filling the ink cartridge 26 to be successfully performed. Ink cartridge 26 releasably engages with the holder 28. FIG. 4 shows a holder 28 configured to accommodate a smaller ink cartridge 26 than is the holder 28 of FIG. 3.

A user will attach ink cartridge 26 to holder 28 and then attach holder 28 and ink cartridge 26 to table 2. FIG. 2 shows table 2 in the attachment/removal station 18, with attachment connector 30 available for attachment of a holder 28 and ink cartridge 26. Attachment connector 30 may be a snap or bayonet connector or any of the other connectors known in the art.

From FIGS. 3 and 4, holder 28 is equipped with an absorbent 32 located immediately below the print head 34 of the ink cartridge 26. Absorbent 32 collects any ink or cleaning fluid that leaks from print head 34 during the cleaning or filling of ink cartridge 26.

Figure 5:
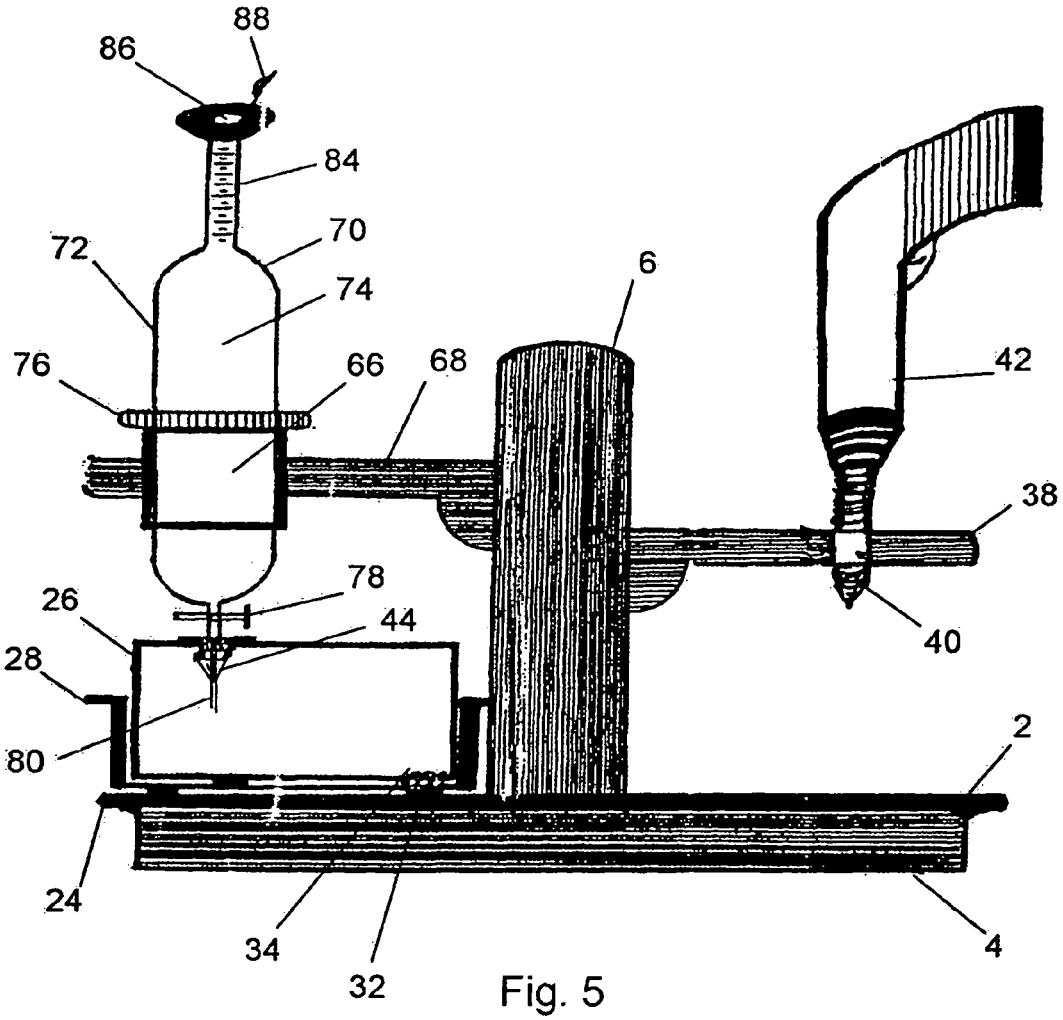
FIG. 5 is a side view of the apparatus.
Figure 7:
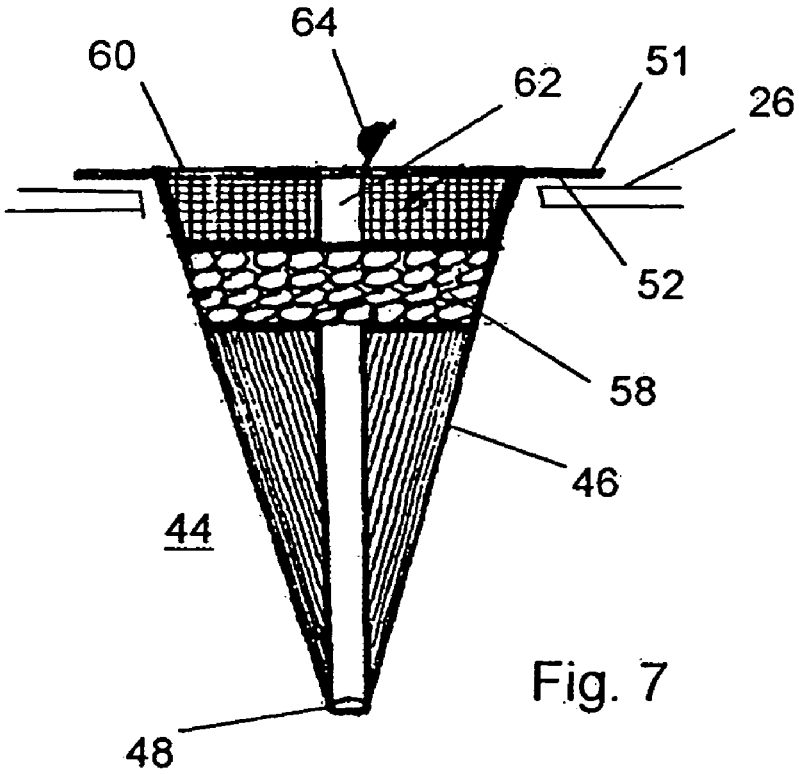
FIG. 7 is a cross section of the cartridge sealing assembly.
Figure 6:
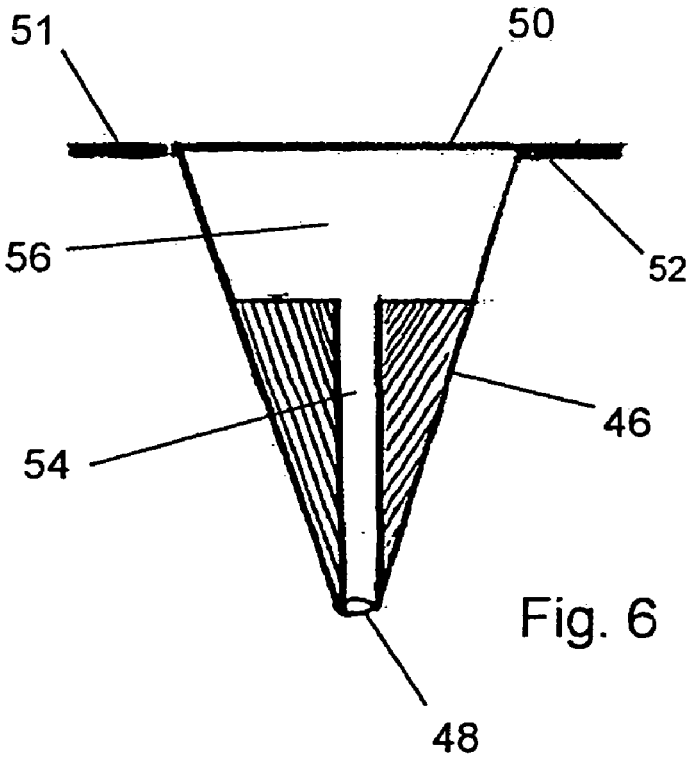
FIG. 6 is a cross section of the cartridge sealing assembly body and sealing material.
Figure 9:
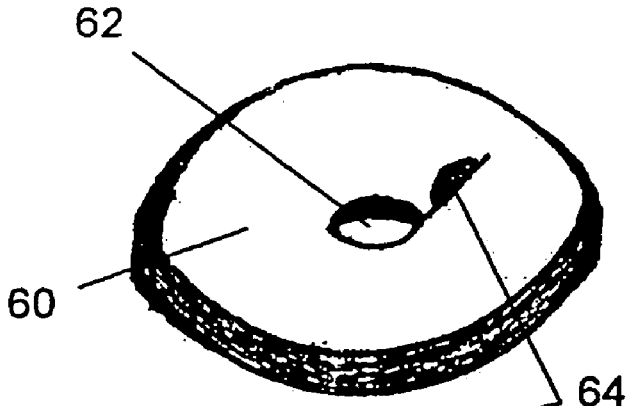
FIG. 9 is a perspective view of the removable first cap.
Figure 8:
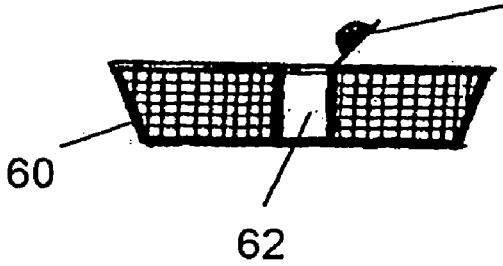
FIG. 8 is a cross section of the removable first cap.

From FIGS. 1, 2, and 5, drilling station 20 is for the purpose of drilling an aperture 36 of an appropriate size in an appropriate location on ink cartridge 26. Drill guide 38 is rigidly mounted on member 6, which is in turn rigidly attached to base 4. The drill guide 38 has a hole 39 at a pre-determined location adapted to receive a drill bit 40 of a drill 42. Said drill 42 is used to enlarge a pre-existing hole 36 on the top surface of the ink cartridge or to create a new hole on the top surface of the ink cartridge. Table 2 is rotated until catch 12 locates holder 28 and cartridge 26 in the drilling station 20. Drill guide 38 is then in the correct position to allow drill bit 40 of drill 42 to properly drill aperture 36. The user then drills aperture 36 using drill 42 and drill guide 38, illustrated by FIG. 5. Drill 42 may be a miniature self-powered drill or any suitable drill.

After aperture 36 is drilled in cartridge 26, drill 42 and drill bit 40 are withdrawn, catch 8 is released from stop 12 and table 2 is rotated to catch 14, corresponding to cartridge sealing assembly insertion station 22. The cartridge sealing assembly 44, illustrated by FIGS. 6–10, is used to seal the aperture 36 of ink cartridge 26 against leakage of ink, cleaning solution or air, while allowing cleaning fluid and ink to flow into ink cartridge 26.

The cartridge sealing assembly 44 has a sealing assembly body 46, a first end 48, a second end 50 and a flange 51. The body 46 is generally conical in shape and approximately 12 mm in length and approximately 8 mm in diameter. The first end 48 corresponds to the apex of the cone and is inserted by the user into the aperture 36. The body 46 of cartridge sealing assembly 44 has an outside surface 52 that sealably engages ink cartridge 26 by any conventional means, including an interference fit, screw or bayonet connection, use of a gasket, use of an adhesive, thermal or friction welding or any of the other means known in the art. The flange 51 firmly contacts the upper surface of ink cartridge 26. Body 46 of cartridge sealing assembly 44 also may be formed as an integral part of ink cartridge 26.

The first end 48 of the sealing assembly body 46 is solid, other than a pin-receiving opening 54 through which fluid may flow into the ink cartridge 26. The body defines a sealing assembly body interior 56. A sealing material, which may be a sponge 58 appears in sealing assembly body interior 56 and is held in place by first cap 60. Cap 60 defines a first cap aperture 62 through which fluid may flow into ink cartridge 26. Cap 60 and body 46 compress sponge 58, causing sponge to reasonably seal pin-receiving opening 54 from fluid or air leakage. Sponge 58 is selected to be soft. Sponge 58 in its uncompressed form is a cylinder approximately 6 mm in diameter and 15 mm long. First cap aperture 62 is selectably sealable by second cap 64. If the apparatus of the Invention is supplied as a kit, extra pieces of sponge 58 are supplied with the kit so that a user may replace sponge 58 that becomes worn and that will no longer adequately seal ink cartridge 26. A user may be alerted to such a worn sponge 58 by a continuous leak from ink cartridge 26.

Figure 10:
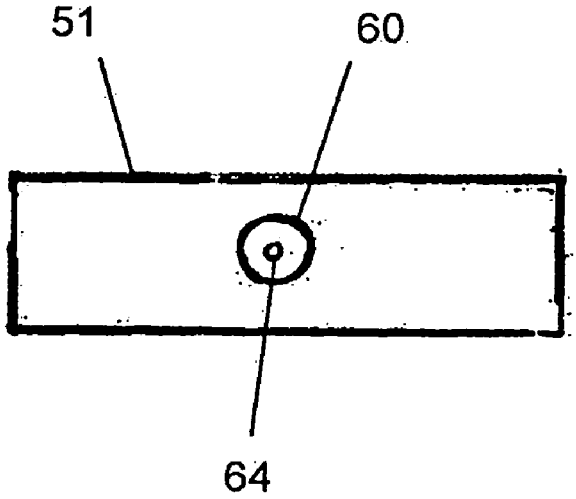
FIG. 10 is a top view of a cartridge sealing assembly and flange.

FIG. 10 is a top view of the cartridge sealing assembly 44 including flange 51.

After the cartridge sealing assembly 44 is installed in aperture 36, catch 8 is released from stop 14 and table 2 is manually rotated with respect to base 4 until catch 8 latches with stop 16, corresponding to the fluid addition station 24. An ink cartridge 26 is cleaned using a cleaning fluid and filled with ink at the fluid addition station 24.

Fluid addition station 24 includes fluid addition guide 66. Fluid addition guide 66 is rigidly mounted on fluid addition guide arm 68, which in turn is rigidly mounted on member 6. When the table 2 is in fluid addition position 24, fluid addition guide 66 is in the correct position to allow fluid to flow into ink cartridge 26 through cartridge sealing assembly 44.

Figure 11:
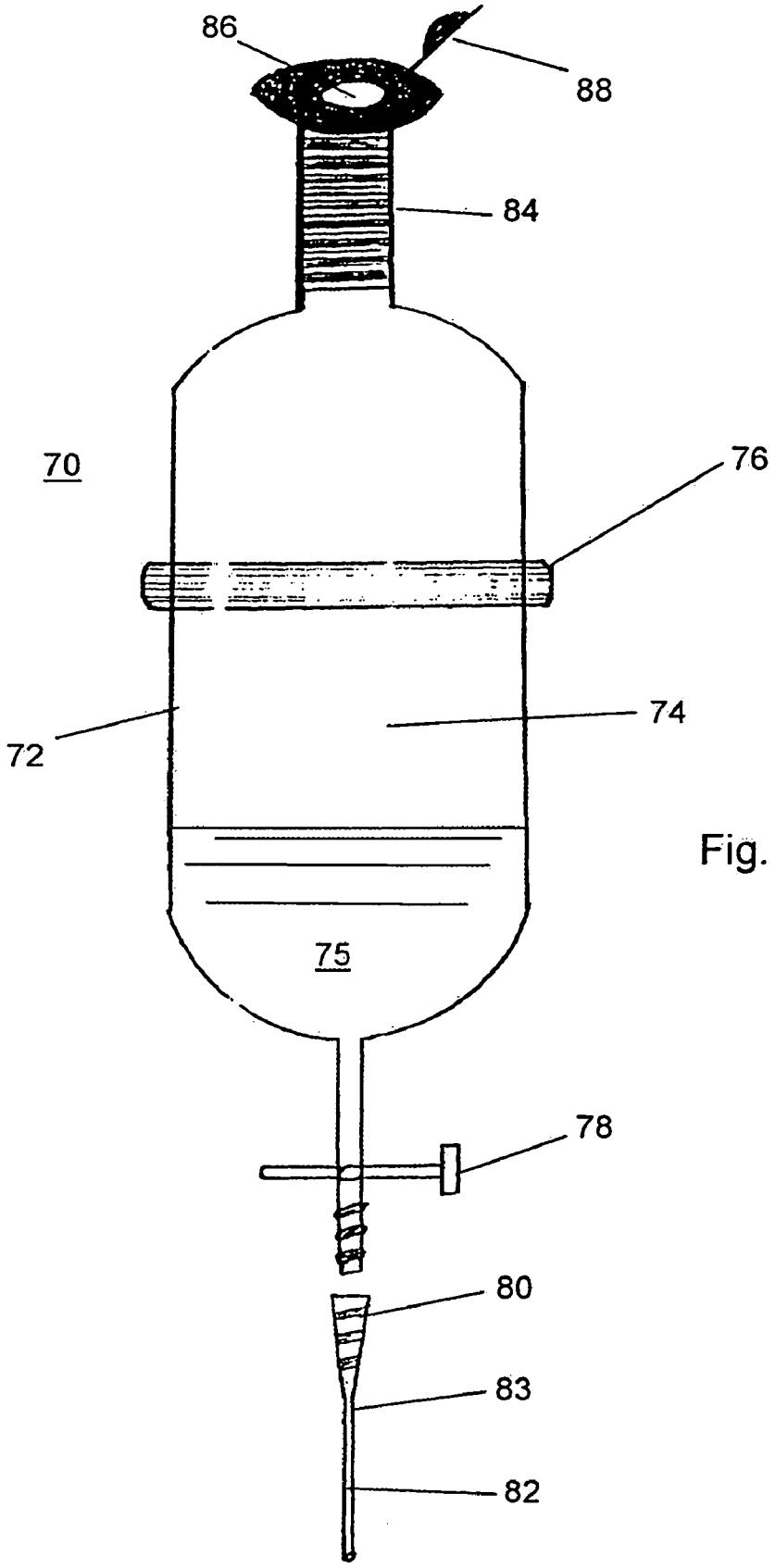
FIG. 11 is a side view of a reservoir.

A reservoir 70 has a reservoir body 72 that defines a reservoir interior volume 74 containing a fluid 75. The reservoir body 72 is designed to be releasably retained by the fluid addition guide 66. In the embodiment illustrated by FIGS. 5 and 11, the fluid addition guide 66 is in the shape of a hollow cylinder that is open at both ends. The reservoir body 72 also is cylindrical and is a sliding fit within the fluid addition guide 66. The reservoir body 72 is retained in the correct position for allowing fluid 75 to flow into the ink cartridge 26 by reservoir stop 76, which is sized so that it will not pass through the fluid addition guide 66.

The reservoir interior volume 74 is sized to hold a convenient amount of cleaning fluid or ink, generally 40 cc. The reservoir interior volume 74 is in fluid communication with a valve 78. A hollow pin 80 defines a pin channel 82 and has a pin outside wall 83. The hollow pin 80 is approximately 15 mm in length. When valve 78 is opened, pin channel 82 is in fluid communication with reservoir interior 74. Hollow pin 80 may be attached to reservoir 70 by a threaded connection.

Reservoir opening 86 is selectably sealed with a reservoir cap 88. Reservoir cap 88 allows reservoir 70 to be refilled with fluid 75. When closed, reservoir cap 88 seals reservoir opening 86.

Reservoir 70 includes a compressible portion 84. Compressible portion 84 is composed of a resilient material and conveniently sized so that a user may pinch compressible portion 84 between the user's thumb and a finger, compressing the compressible portion 84. When reservoir cap 88 is closed, pinching of the compressible portion 84 by user increases the pressure within reservoir interior volume 74. If valve 78 is open and reservoir 70 contains only air, the increase in pressure expels air from reservoir interior volume 74 through valve 78 and through channel 82 in hollow pin 80. Compressible portion 84 is configured so that a pinch of compressible portion 84 by a user will eject a graduated amount of air from hollow pin 80.

Cleaning of the ink cartridge 26 before filling with ink is desirable to remove dried ink residues that may block the orifices of the print head 34 and interfere with printing. To clean an ink cartridge 26 and as shown by FIG. 5, the ink cartridge 26 and holder 28 are placed in the fluid addition station 24 by appropriately rotating table 2 with respect to base 4. Body 72 of reservoir 70 is placed in fluid addition guide 66, which automatically aligns hollow pin 80 and first cap aperture 62 in cartridge sealing assembly 44, mounted on ink cartridge 26.

The user pushes hollow pin 80 through first cap aperture 62, through sponge 58, through channel 54 to interior of ink cartridge 26. Hollow pin 80 is sized to extend entirely through cartridge sealing assembly 44 into ink cartridge 26.

The user then closes the valve 78. A predetermined amount of fluid 75 is placed in reservoir 70 through opening 86. In this instance, fluid 75 is cleaning fluid.

The user then opens valve 78. Air flows through reservoir opening 86 and fluid 75 flows through channel 82 in hollow pin 80 into ink cartridge 26. It is desireable to provide a positive air pressure within the ink cartridge 26 when the predetermined amount of fluid 75 has flowed into cartridge 26. The user closes reservoir cap 88 and gently squeezes the compressible portion 84 of reservoir 70, releasing a predetermined amount of air into the cartridge 26.

The user, while continuing to squeeze the compressible portion 84, closes valve 78.

Fluid 75 is allowed to remain in the cartridge 26 for a predetermined period of time until ink residues are adequately removed.

The user then opens valve 78 and cap 88, which permits air to flow into the ink cartridge 26 through reservoir 70 and allows fluid 75 to flow out of ink cartridge 26 through print head 34. Fluid 75 that leaks from print head 34 is collected by absorbent 32.

Alternatively, the user may remove the first cap 60 and sponge 58 to allow cleaning fluid to drain out of the cartridge 26.

User also may release air into in cartridge 26 by pinching compressible portion 84 when reservoir cap 88 is closed and valve 78 is open to force cleaning fluid from ink cartridge 26.

Reservoir 70 is removed from the fluid addition guide 66 and hollow pin 80 is withdrawn from cartridge sealing assembly 44.

Once the ink cartridge 26 has been cleaned and drained of cleaning fluid, ink cartridge 26 may be filled with ink. The following ink-filling steps require that the ink cartridge 26 and holder 28 are in the fluid addition station 24, that reservoir 70 is installed in fluid addition guide 66, and that hollow pin 80 is inserted through cartridge sealing assembly 44. Valve 78 is first closed and a predetermined amount of ink is added to reservoir 70. Valve 78 is opened while reservoir cap 88 also is open, allowing ink to flow through the hollow pin 80 and into ink cartridge 26. After the predetermined amount of ink has flowed into the cartridge 26, valve 78 is closed, preventing air from entering the cartridge 26 and thus preventing ink from leaking from the cartridge 26 through the print head 34. The cartridge sealing assembly 44 provides an air-tight seal between the cartridge 26 and the outer wall 83 of hollow pin 80, preventing leakage of air into the cartridge 26 and leakage of ink from the cartridge 26. Any leakage of ink that occurs during filling of the cartridge 26 is collected by absorbent 32.

Once ink is in the cartridge 26, it is desirable to provide a positive air pressure within the cartridge 26. The reservoir cap 88 is closed and the valve 78 is opened. The user will gently squeeze the compressible portion 84 of reservoir 70, forcing a predetermined amount of air into the cartridge 26. The user then will close valve 78 while continuing to squeeze the compressible portion 84. Reservoir 70 is removed from the fluid addition guide 66 and hollow pin 80 is withdrawn from cartridge sealing assembly 44. The opening cut by hollow pin 80 in sponge 58 is sealed by sponge 58, preventing leakage of air or ink through the opening. The ink cartridge 26 now is filled and ready for use.

To release the ink cartridge 26 from the table 2, the user will release catch 8 and rotate table 2 with respect to base 4 until table stop 10 is engaged, corresponding to the attachment/release station 18. Holder 28 is released from table 2 and filled ink cartridge 26 is released from holder 28. User will close top cap 64 to prevent leakage of fluid 75 from ink cartridge 26 and to provide extra security and will cap hollow pin 80.

After a cartridge sealing assembly 44 is installed in a cartridge 26, the drilling and cartridge sealing assembly 44 installation procedures need not be repeated for that cartridge 26. Sponge 58 in the cartridge sealing assembly 44 will require periodic replacement to maintain an air-tight seal.

The present invention is useful for refilling ink cartridges 26 that are not filled with a synthetic foam or similar material. The invention may be used for refilling cartridges that are partially filled with a foam provided that hollow pin 80 is not inserted into the foam.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

We claim:

1. An apparatus for refilling an ink cartridge, the apparatus comprising:

a. a table, said table being adapted to receive and releasably retain the ink cartridge;

b. a base, said table being rotatably attached to said base;

c. a drilling station disposed on said table, said drilling station defined by a first pre-determined rotational relationship between said table and said base;

d. a drill guide attached to said base, said drill guide defining an aperture locating a drill for drilling an aperture in the ink cartridge when the ink cartridge is on the table and is in said drilling station.

2. The apparatus of claim 1, further comprising:

a. a fluid addition station of said table defined by a second pre-determined rotational relationship between said table and said base;

c. a fluid addition guide attached to said base and defining a fluid addition location for adding a fluid to the ink cartridge when said table is in said fluid addition station.

3. The apparatus of claim 2, further comprising: a reservoir, said fluid addition guide adapted to receive said reservoir; said reservoir adapted to be placed in fluid communication with the ink cartridge when said table is in said fluid addition location.

4. The apparatus of claim 3 wherein said reservoir comprises:

a. a reservoir body;

b. a reservoir interior volume defined by said reservoir body;

c. a valve, said valve in fluid communication with said reservoir interior volume;

d. a hollow pin, said hollow pin defining a pin channel, said pin channel being in fluid communication with said valve;

e. a compressible portion in fluid or pneumatic communication with said reservoir interior volume.

5. The apparatus of claim 4, further comprising: a cartridge sealing assembly, said cartridge sealing assembly being adapted to sealably engage said aperture, said hollow pin having a pin outside wall, said cartridge sealing assembly being adapted to be penetrated by said hollow pin and to sealably engage said pin outside wall, said penetration of said cartridge sealing assembly by said hollow pin creating an opening, said cartridge sealing assembly being adapted to sealably close said opening upon withdrawal of said hollow pin from said opening.

6. The apparatus of claim 5, said cartridge sealing assembly comprising:

a. a sealing assembly body, said sealing assembly body having a first end, said first end of said sealing assembly body defining generally a cone having an apex and a sealing assembly body interior, said apex of said cone appearing at said first end of said sealing assembly body, said first end of said sealing assembly body being adapted to be inserted into said aperture;

b. a sealing material, said sealing material appearing within said sealing assembly body interior of said first end of said sealing assembly body.

7. The apparatus of claim 6, said cartridge sealing assembly further comprising:

a. a removable first cap, said sealing assembly body having a second end, said removable first cap engaging said second end of said sealing assembly body, said removable first cap defining a first cap aperture;

b. a removable second cap removably engaging said first cap aperture.

8. The apparatus of claim 7 wherein said sealing material is a sponge.

9. The apparatus of claim 8, further comprising: a cartridge sealing assembly insertion station of said table defined by a third pre-determined rotational relationship between said table and said base, said cartridge sealing assembly insertion station being adapted for insertion of said cartridge sealing assembly into sealable engagement with said aperture.

10. The apparatus of claim 9, further comprising: an attachment/removal station of said table defined by a fourth pre-determined rotational relationship between said table and said base, said attachment/removal station being adapted to receive and to releasably retain said ink cartridge.

11. The apparatus of claim 2, said adaptation of said table to receive and releasably retain the ink cartridge comprising: a holder, said holder being adapted to receive and releasably retain the ink cartridge, said table being adapted to receive and releasably retain said holder.

12. The apparatus of claim 2, further comprising: an absorbent, the ink cartridge having a print head, said holder retaining said absorbent adjacent to said print head, said absorbent being adapted to contain leaks of said ink from said print head.

13. A method of refilling an ink cartridge, the method comprising the steps of:

a. attaching the ink cartridge to a table, said table being adapted to rotate with respect to a base;

b. rotating said table with respect to said base to a drilling station;

c. drilling an aperture in the ink cartridge;

d. rotating said table with respect to said base to a fluid addition station;

e. allowing fluid to flow into the ink cartridge from a reservoir through said aperture.

14. The method of claim 13, the method comprising the following steps after said step of drilling said aperture and prior to said step of rotating said table to said filling position:

a. rotating said table with respect to said base to a cartridge sealing assembly installation station;

b. inserting a cartridge sealing assembly into said aperture, said cartridge sealing assembly being adapted to sealably engage said aperture.

15. The method of claim 14, said cartridge sealing assembly comprising:

a. a sealing assembly body, said sealing assembly body having a first end, said first end of said sealing assembly body defining generally a cone having an apex and a sealing assembly body interior, said apex of said cone appearing at said first end of said cartridge sealing assembly body, said first end of said sealing assembly body being adapted to be inserted into said aperture;

b. a sponge contained within said sealing assembly body interior.

16. The method of claim 14, said step of allowing ink to flow into the ink cartridge further comprising:

a. placing a reservoir into a fluid addition guide, said reservoir having a reservoir interior volume containing a fluid, said reservoir having a hollow pin defining a pin channel, said pin channel being in selectable fluid communication with said reservoir interior volume;

b. inserting said hollow pin through said cartridge sealing assembly into the ink cartridge, said hollow pin penetrating said sponge, said hollow pin having an outside wall, said sponge sealably engaging said outside wall of said hollow pin.

17. The method of claim 16 wherein said reservoir having a reservoir cap selectably sealing a reservoir opening, said step of allowing said fluid to flow into the ink cartridge further comprising: opening said reservoir cap and said valve, thereby allowing said fluid to flow from said reservoir through said hollow pin and through said cartridge sealing assembly into the ink cartridge.

18. The method of claim 17 wherein said reservoir has a compressible portion in pneumatic communication with said reservoir interior volume, said step of allowing said ink to flow into the ink cartridge further comprising: applying a positive air pressure within the ink cartridge by squeezing said compressible portion.

19. The method of claim 18 wherein said fluid consists of a cleaning fluid or an ink.

20. The method of claim 13, further comprising:

a. rotating said table to an attachment/removal position;

b. removing the ink cartridge from the table.

* * * * *